US007999672B1

(12) United States Patent
Feibelman

(10) Patent No.: US 7,999,672 B1
(45) Date of Patent: Aug. 16, 2011

(54) ANTI-THEFT BOX AND METHOD OF MAKING SAME

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 375 days.

(21) Appl. No.: 12/107,235

(22) Filed: Apr. 22, 2008

(51) Int. Cl.
*G08B 13/14* (2006.01)

(52) U.S. Cl. ..... 340/568.1; 340/572.1; 340/572.8

(58) Field of Classification Search ..... 340/568.1, 340/571, 572.1, 572.8, 539.11, 10.1; 235/375, 235/385; 206/308.1, 308.2, 387.11, 301.8; 426/232
See application file for complete search history.

(56) References Cited

U.S. PATENT DOCUMENTS

| | | | | |
|---|---|---|---|---|
| 5,460,266 | A | 10/1995 | Mundorf et al. | |
| 5,601,188 | A | 2/1997 | Dressen et al. | |
| 6,395,373 | B2 * | 5/2002 | Conti et al. | 428/138 |
| 6,508,355 | B2 * | 1/2003 | Au et al. | 206/6.1 |
| 7,583,194 | B2 * | 9/2009 | Appalucci et al. | 340/572.8 |
| 7,602,292 | B2 * | 10/2009 | Watanabe | 340/572.1 |
| 2003/0043039 | A1 | 3/2003 | Salemi et al. | |
| 2008/0218356 | A1 * | 9/2008 | Frew et al. | 340/572.8 |
| 2008/0272131 | A1 * | 11/2008 | Roberts et al. | 220/592.25 |

* cited by examiner

*Primary Examiner* — Van T. Trieu
(74) *Attorney, Agent, or Firm* — Jodi-Ann McLane

(57) ABSTRACT

An anti-theft box that is molded to support an electronic article surveillance tag within a cavity is provided. Disposed within either the base or the top of the box is a cavity for supporting an EAS sensor. The cavity is sized to receive the EAS sensor and may include a cover for further securing the sensor within the cavity to help prevent tampering with the sensor. The cavity may be visible from the exterior to a consumer so that the consumer can see the EAS marker. In one embodiment the cavity is separately formed and is inserted within an opening in the base of the box. The box may be used to support a variety of articles, including articles of jewelry.

22 Claims, 14 Drawing Sheets

ANTI-THEFT BOX AND METHOD OF MAKING SAME

BACKGROUND

It is well known in the art to use electronic article surveillance (EAS) sensors in order to prevent the theft of consumer products. Such electronic sensors trigger an alarm if not detached or disarmed before the product is removed from the store. For many products, electronic sensors have been very effective in deterring theft. However, such sensors can be difficult to attach to certain products, for example jewelry, and can often be easily removed from such items even when attached. For such items the sensor is often attached to the card supporting the product or may be loosely hidden within the interior of the box housing the product. While generally a deterrent, if the user can readily remove the sensor, such as when it is hidden within the interior, it defeats the purpose of the sensor.

SUMMARY

The anti-theft box of the present application addresses the need of providing an anti-theft tag that can be readily secured within a jewelry box and which can be either visible or not visible to the user, and is tamper resistant. The box is molded to support an electronic article surveillance (EAS) sensor within a cavity provided within either the base or the top of the box. The cavity is sized to receive the EAS sensor and may include a cover for further securing the sensor within the cavity to help prevent tampering with the sensor. The box may include both a base and a top cover that are moveable between a closed and an open position. The cavity may be disposed within either the base or the top cover of the box and may be visible to the consumer or may be covered by an additional outer layer so as to be hidden from view.

The anti-theft box described herein discourages unauthorized removal of the box from a store by a consumer. The features of the anti-theft box as described herein may be used with any of a variety of articles, as discussed below.

BRIEF DESCRIPTION OF THE DRAWINGS

The foregoing and other objects, features and advantages will be apparent from the following description of particular embodiments, as illustrated in the accompanying drawings in which like reference characters refer to the same parts throughout the different views. The drawings are not necessarily to scale, emphasis instead being placed upon illustrating the principles disclosed herein wherein.

DETAILED DESCRIPTION OF THE ILLUSTRATIVE EMBODIMENTS

The embodiments disclosed herein relate to a box for supporting an article, for example an article of jewelry, including an anti-theft tag to deter theft of the box and article. As used herein, the term "article" refers to any type or style of consumer product. As also used herein, the term "electronic article surveillance" tag or marker refers to any conventional electronic article surveillance (EAS) sensor that trigger an alarm if not detached or disarmed before the product is removed from the store. Finally, as used herein, "jewelry" refers to any style or type of jewelry that may be worn by a consumer.

Figure 10:
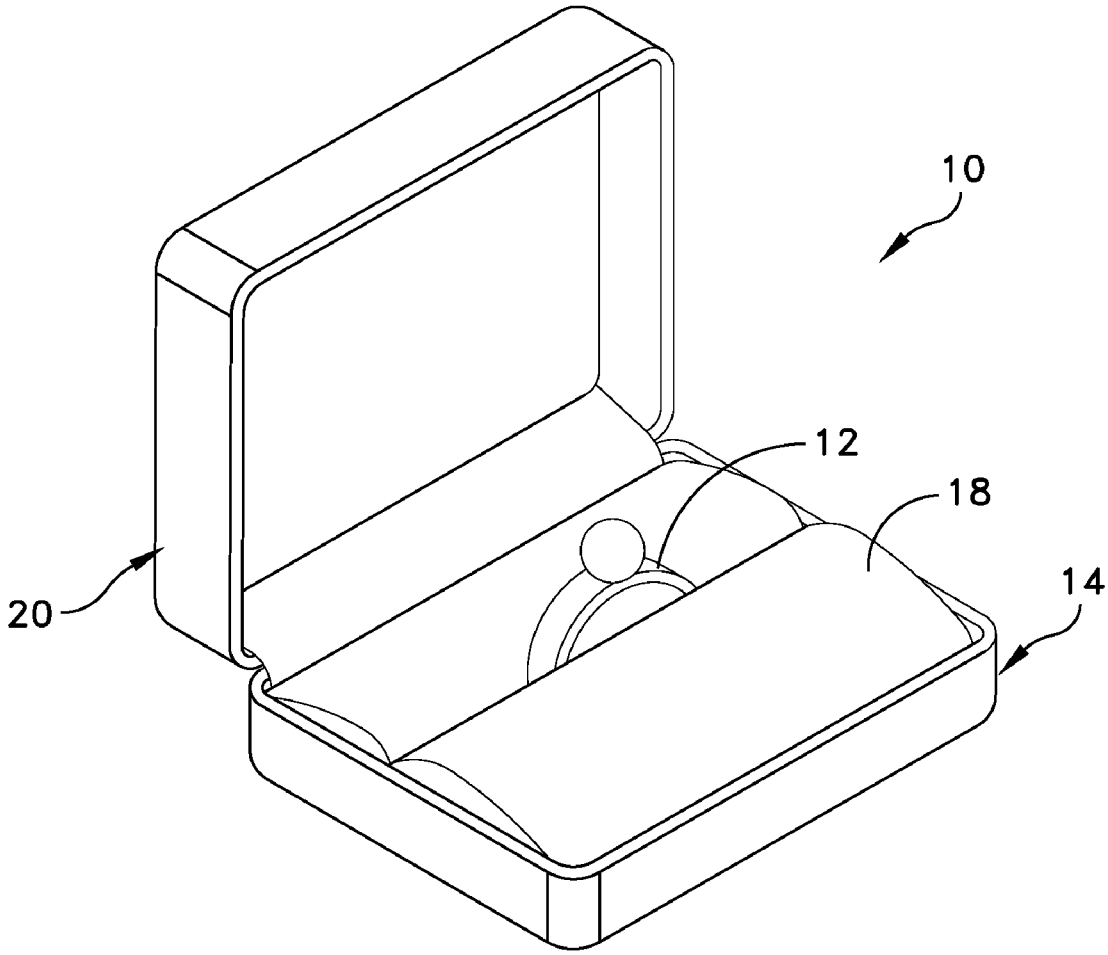
FIG. 10 is a top perspective view of an anti-theft box in an open position according to the present disclosure.
Figure 11:
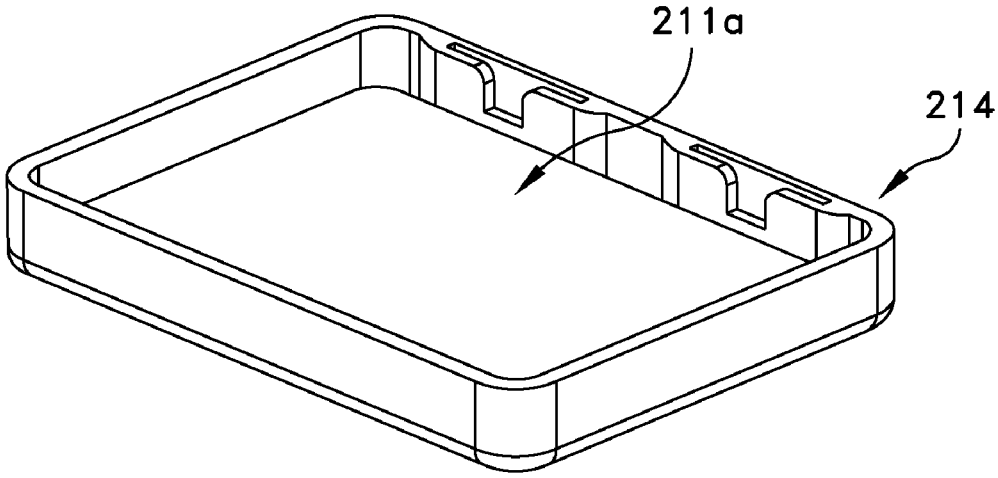
FIG. 11 is a top perspective view of a third exemplary embodiment of a bottom portion of an anti-theft tag box according to the present disclosure.
Figure 12:
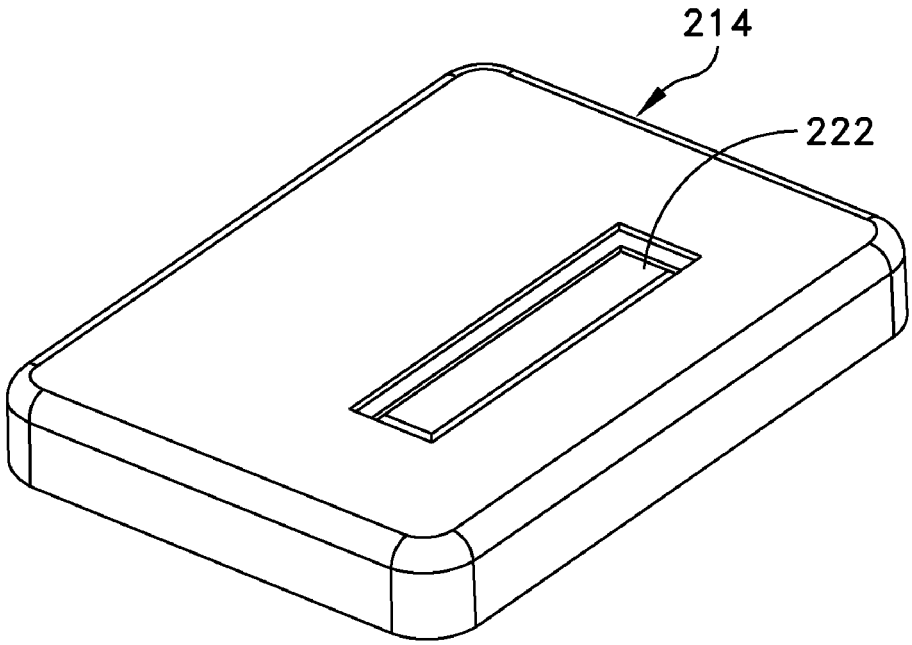
FIG. 12 is a bottom perspective view of the anti-theft tag box of FIG. 11.
Figure 13:
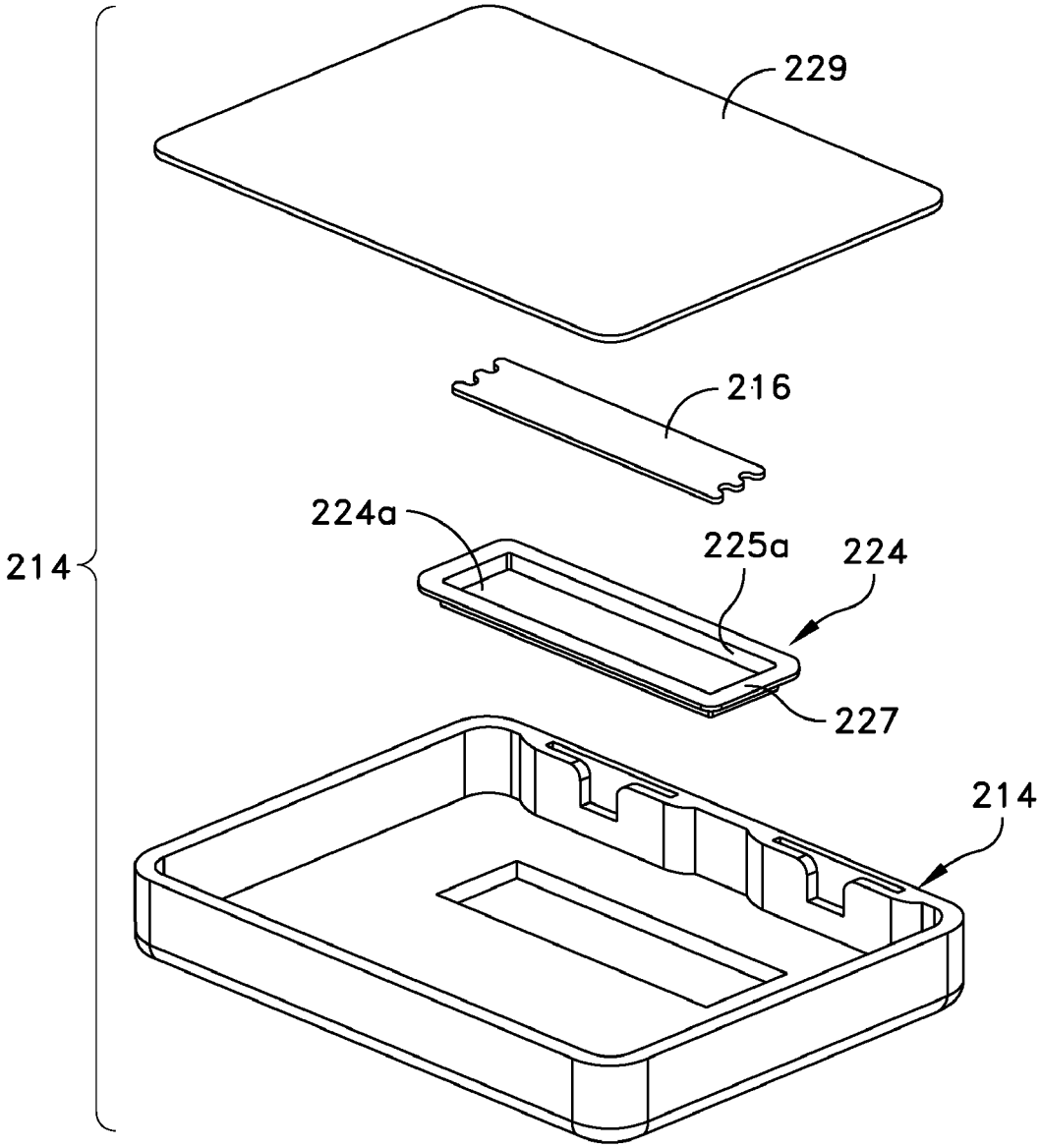
FIG. 13 is an exploded view of the anti-theft tag box of FIG. 11.
Figure 14:
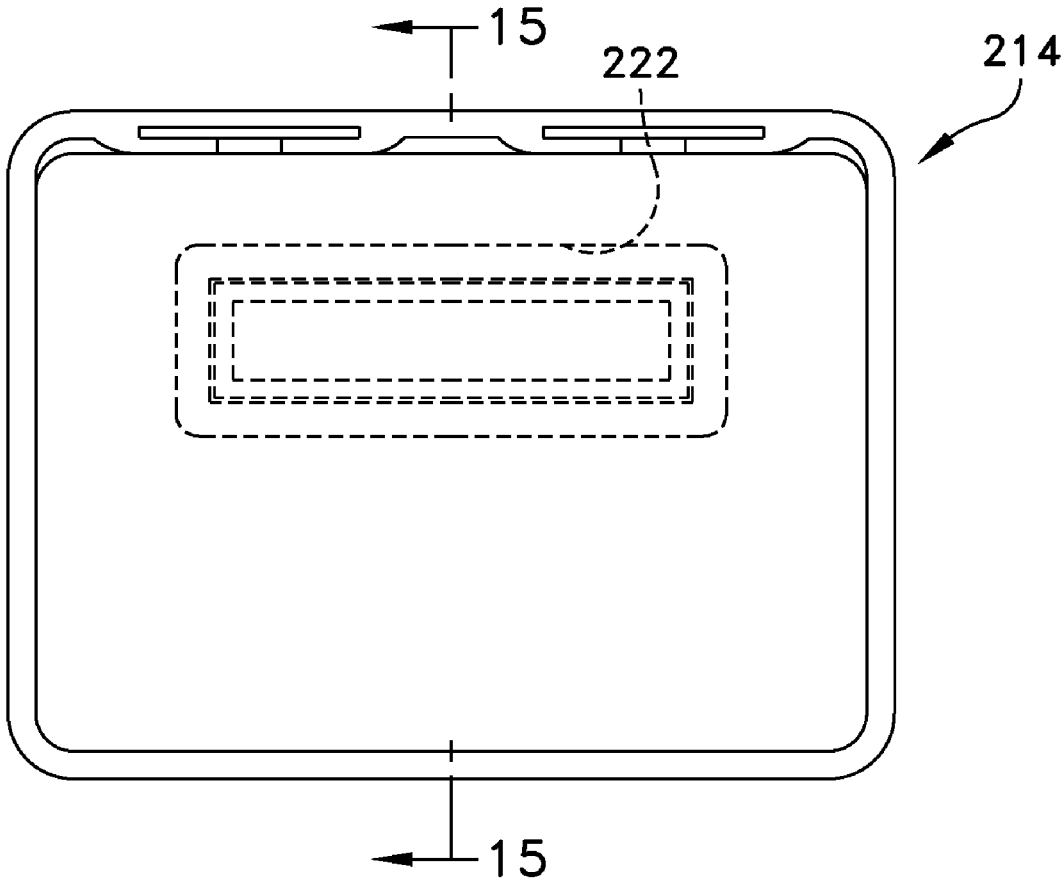
FIG. 14 is a top plan view of the anti-theft tag box of FIG. 11.
Figure 15:
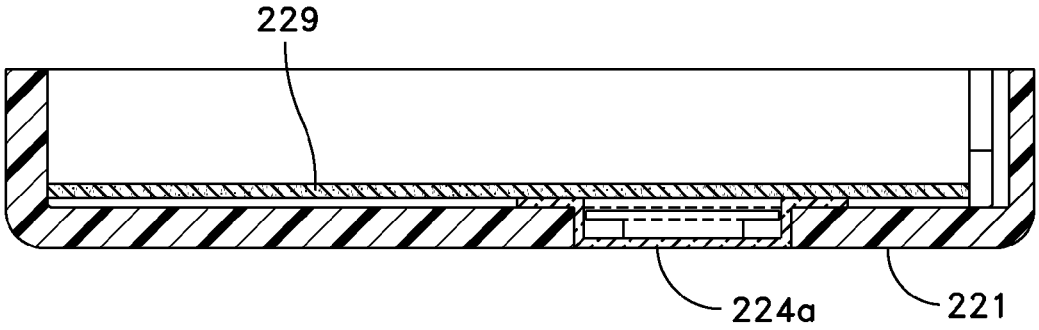
FIG. 15 is a cross-sectional view taken along lines 15-15 of FIG. 14.
Figure 16:
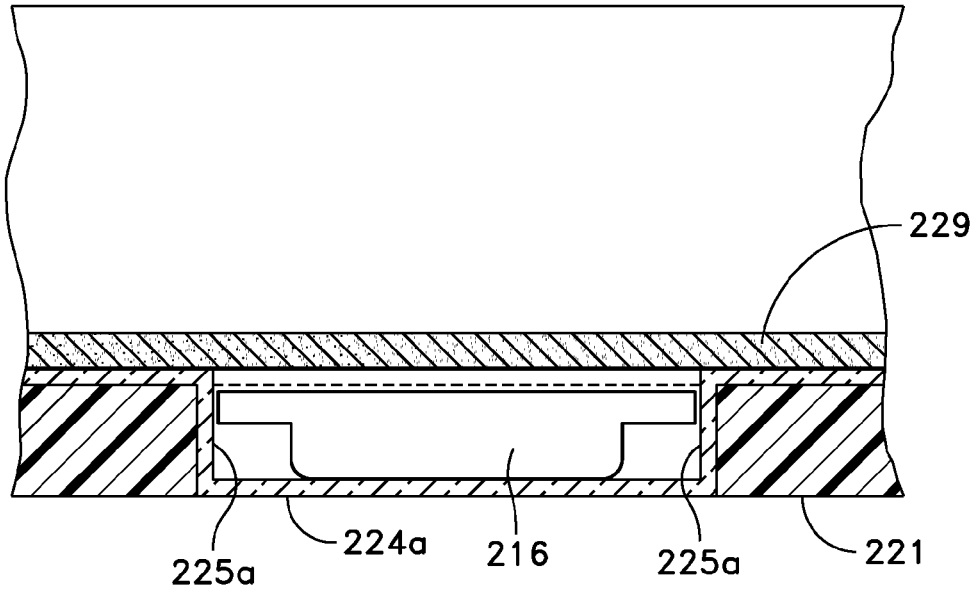
FIG. 16 is an enlarged view of the anti-theft tag box of FIG. 15.
Figure 17:
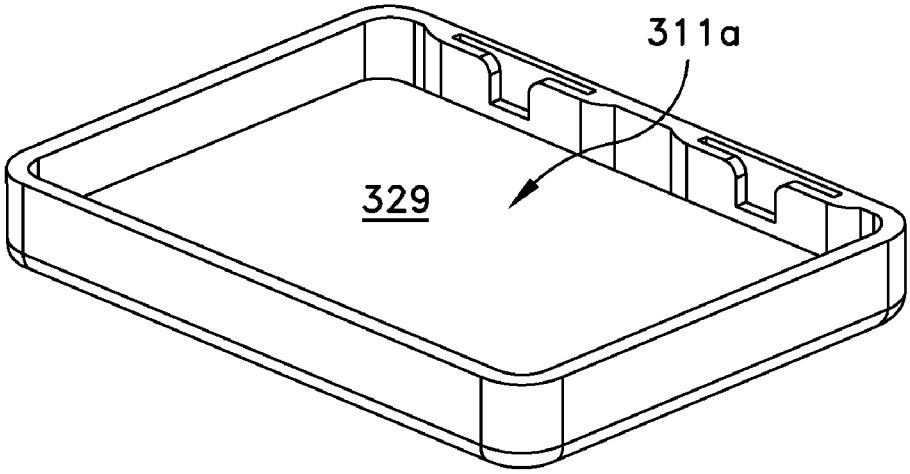
FIG. 17 is a top perspective view of a fourth exemplary embodiment of a bottom portion of an anti-theft tag box according to the present disclosure.
Figure 18:
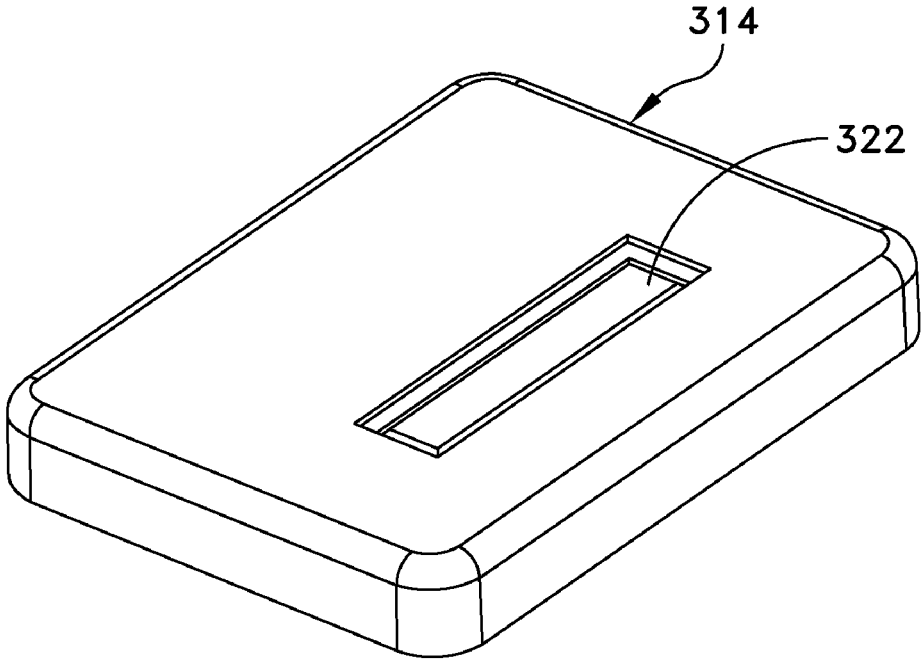
FIG. 18 is a bottom perspective view of the anti-theft tag box of FIG. 17.
Figure 19:
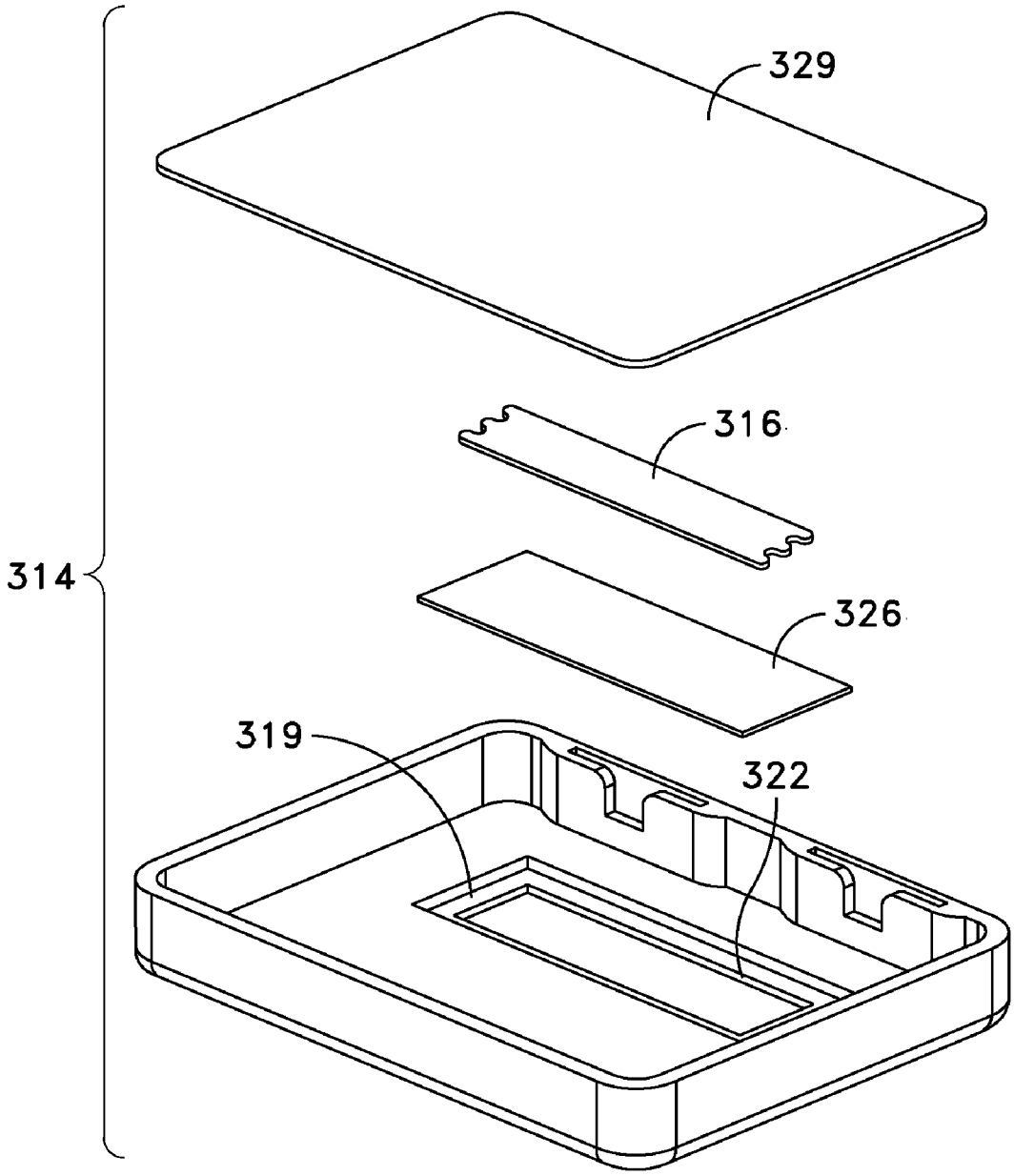
FIG. 19 is an exploded view of the anti-theft tag box of FIG. 17.
Figure 20:
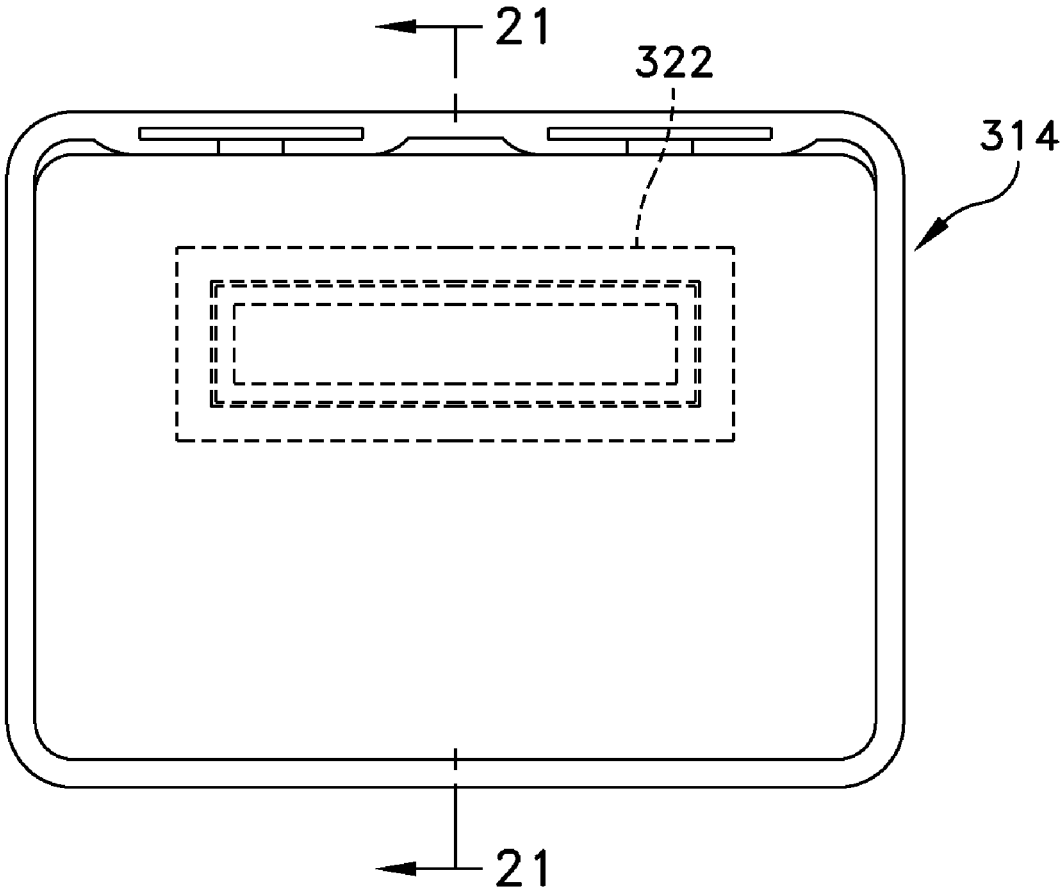
FIG. 20 is a top plan view of the anti-theft tag box of FIG. 17.
Figure 21:
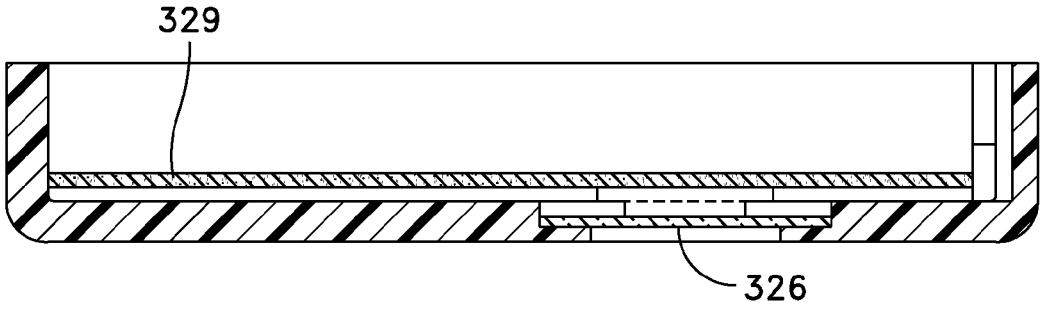
FIG. 21 is a cross-sectional view taken along lines 21-21 of FIG. 20.

Referring initially to FIGS. 1-6, an exemplary anti-theft box 10 for deterring theft of the box and an article 12 (FIG. 10) supported within the box is illustrated. The example anti-theft box 10 includes mating members, for example a base 14 for receiving an article support insert 18 (FIG. 10) that is disposed within the base for supporting article 12, and a top 20 which engages the base in a closed position. In the present embodiment, a cavity 24 is formed as part of the base 14 and is sized to receive an EAS sensor 16, as described in greater detail below. The top 20 may be hinged to the base 14, as shown in FIG. 10, or may sit on top of the base and be removable in the open position. The box 10 is preferably a jewelry box designed to hold a piece of jewelry, for example a ring, in the present embodiment, but alternately may hold any of a variety of consumer items. The base 14 and the top cover 20 may have a generally square or rectangular shape as illustrated, or may have any of a variety of shapes, as would be known to those of skill in the art. The base 14 and top cover 20 may each also include a bottom portion 11*a*, 11*b* having an inner surface 15*a*, 15*b*, and an outer surface 21*a*, 21*b*, respectively, and sidewalls 13*a*, 13*b* extending from the bottom portion.

Disposed within the bottom portion 11*a* of the box 10 is opening 22 for receiving the EAS sensor 16. The opening 22 bounds cavity 24 that supports the EAS sensor, and the opening 22 also includes a cover 26 in order to further secure the sensor within the cavity and to help preclude tampering. In the present embodiment, the cavity 24 includes an open end and a closed end, opposite the open end, the closed end having a bottom wall 24*a* facing the interior of the box, and sidewalls 25*a* extending from the bottom wall. The cavity preferably is molded as a single, unitary piece with the base 14 of the box 10 and has a depth sufficient to support the EAS sensor within the cavity. The EAS sensor 16 may be supported on the bottom wall 24*a*, for example by adhesive, and may be further held in place by cover 26. The open end of the cavity faces the outer surface 21*a* of the box in the present embodiment and the cover 26 is formed as a separate piece, and is made of a transparent material, so that a consumer may view the EAS sensor through the outer surface of the box when in place. The cover is sized so as to fit over the opening 22 and is supported between the bottom, outer surface 21*a* of the box and a wrapped, outer layer 28 of the box in the present embodiment. Unlike traditional metal jewelry boxes, the anti-theft box 10 is preferably molded of a durable plastic, for example high impact polystyrene (HIPS), so as to not interfere with the working of the EAS sensor. Other materials that would not interfere with the workings of the sensor 16 and which could be used to form cavity 24 may also be utilized. The box provides an attractive design which is tamper resistant and which provides visual indication of the anti-theft sensor to the consumer. A method of forming the box 10 will now be described with reference to FIGS. 1-6.

The box 10 may preferably be injection molded from HIPS at a temperature of 200 Celsius with a minimum of 100 tons of clamp force, although alternate materials and parameters may be utilized. During injection molding the cavity 24 formed in the bottom, outer surface 21*a* of the base 14 of the box. The EAS sensor 16 is inserted within the cavity and may be secured within the base of the cavity by adhesive. The cover 26 is then placed over the opening 22 bounding the open end of the cavity. Outer layer 28, which includes an opening 30 sized to fit over opening 22, is then secured over the box in a conventional manner by adhesive, so that the openings 30, 22 are aligned with each other. The outer layer may be made of a variety of materials, for example velvet, velour, paper, bengaline, suede, etc. and other similar material normally used to wrap presentation boxes, as would be known to those of skill in the art. Once the box is formed and the EAS marker is in place, the article support insert 18 is positioned within the base, and thereafter the article can be supported within the box by the insert. Alternately, the cavity 24, opening 22, and the EAS sensor 16 may be formed in the top cover 20 in the same manner as described hereinabove with respect to the base.

Figure 1:
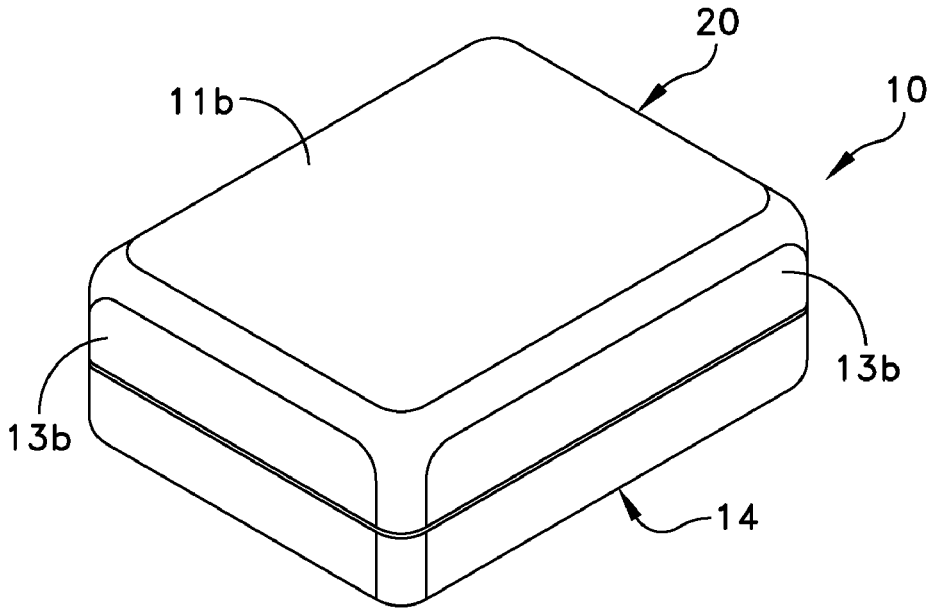
FIG. 1 is a top perspective view of a first exemplary embodiment of an anti-theft box in a closed position according to the present disclosure.
Figure 2:
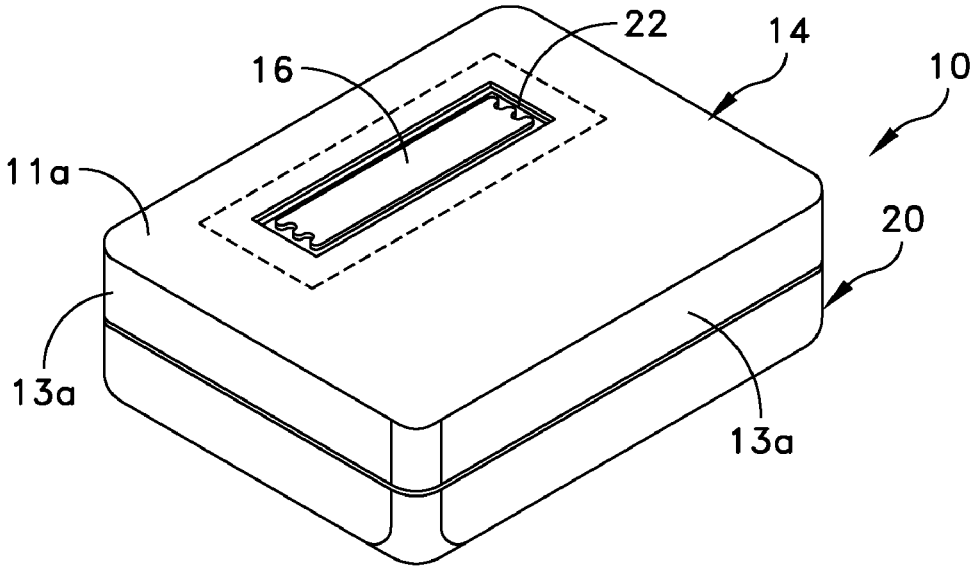
FIG. 2 is a bottom perspective view of the box of FIG. 1.
Figure 3:
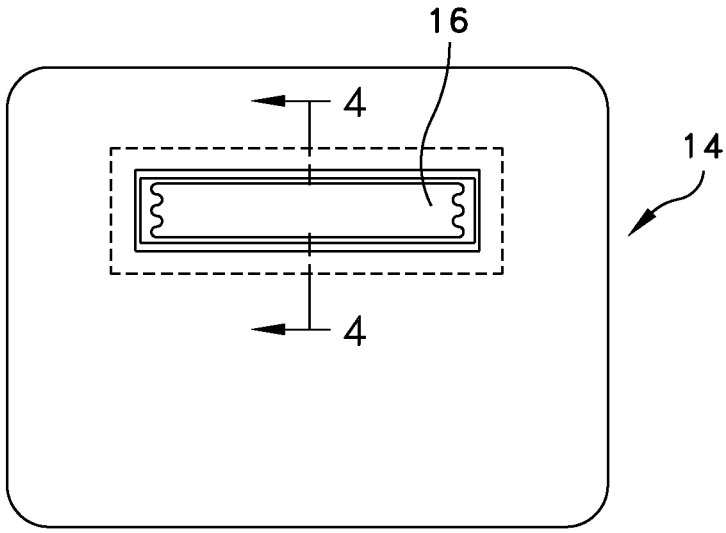
FIG. 3 is a bottom plan view of the box of FIG. 1.
Figure 4:
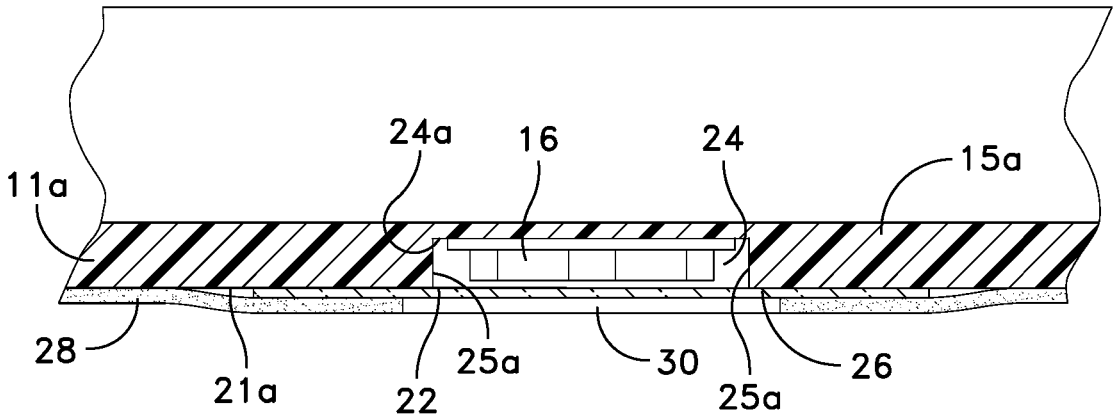
FIG. 4 is a cross-sectional view taken along lines 4-4 of FIG. 3.
Figure 5:
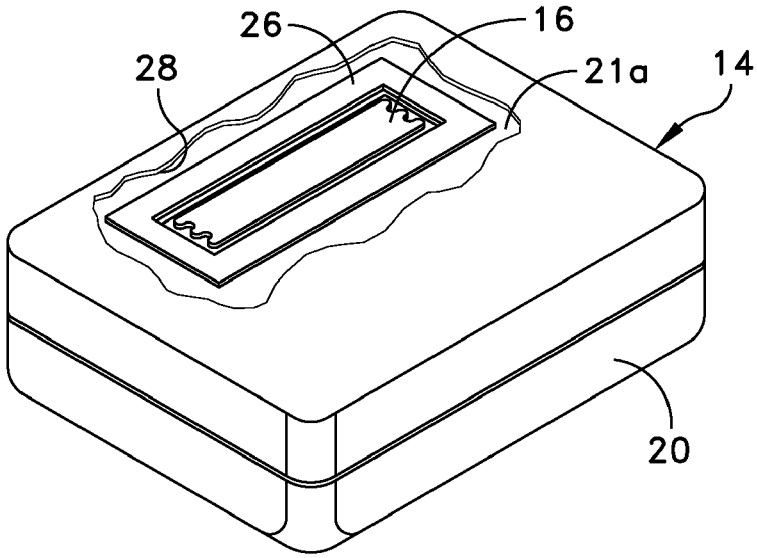
FIG. 5 is a bottom perspective view of the box of FIG. 1 with a portion of the bottom removed.
Figure 6:
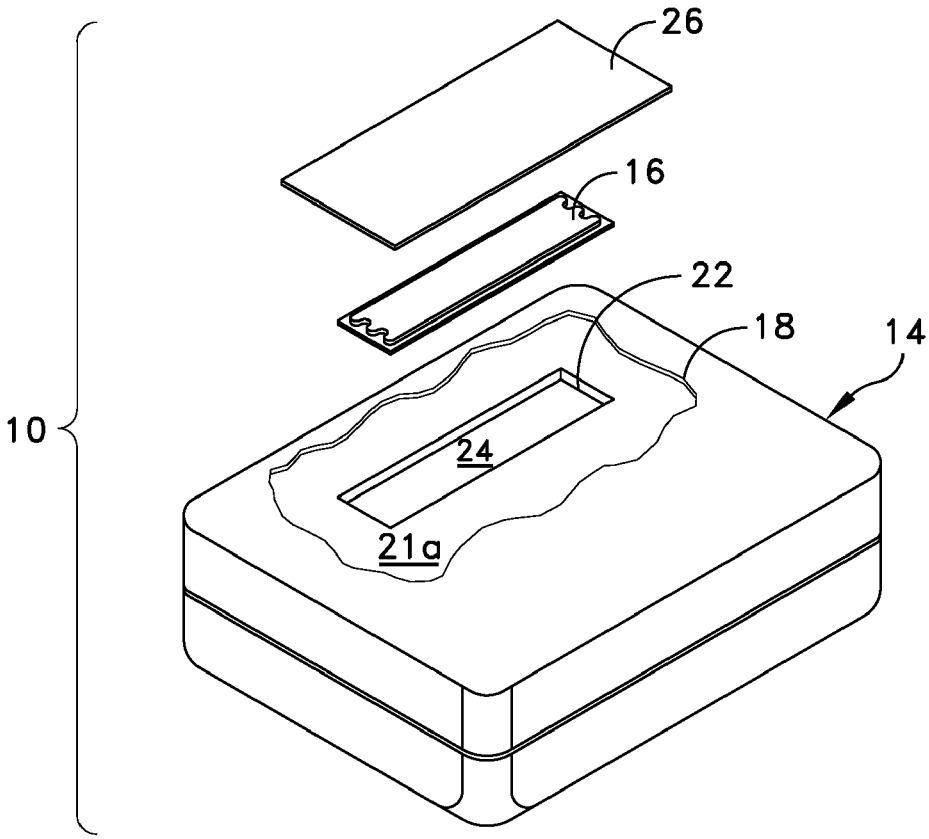
FIG. 6 is an exploded view of the embodiment of FIG. 5.
Figure 7:
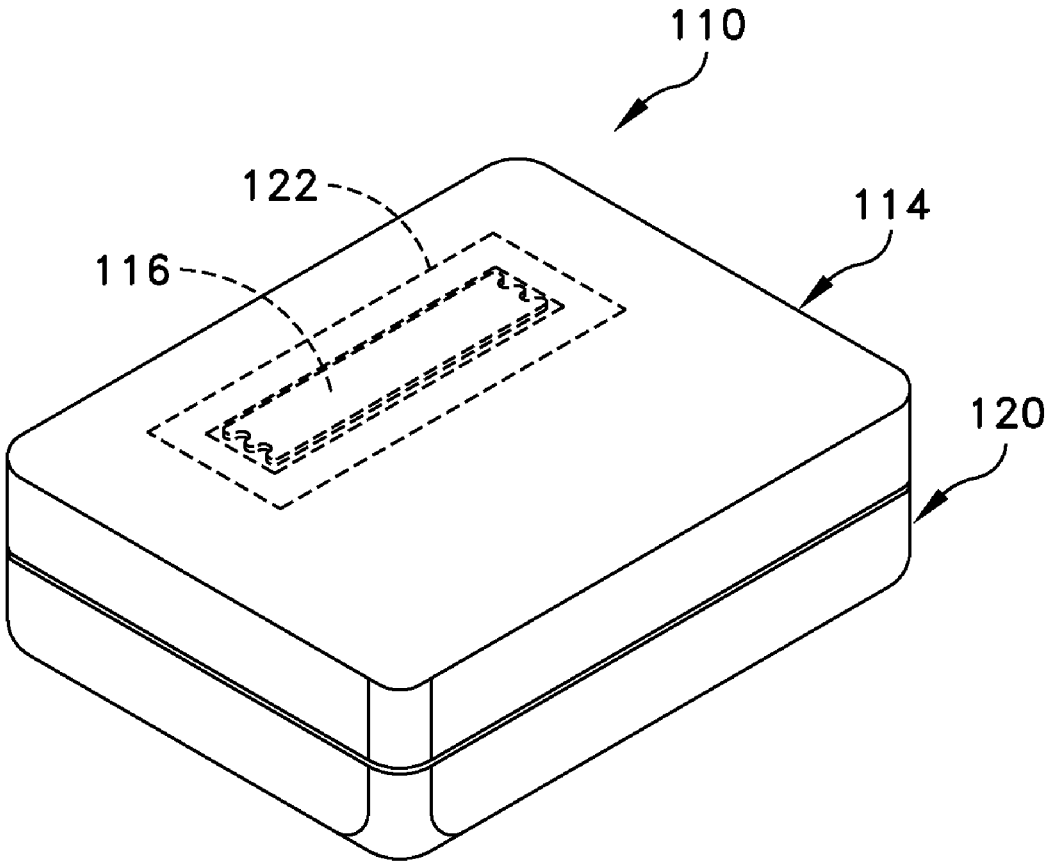
FIG. 7 is a bottom perspective view of a second exemplary embodiment of an anti-theft box according to the present disclosure.
Figure 8:
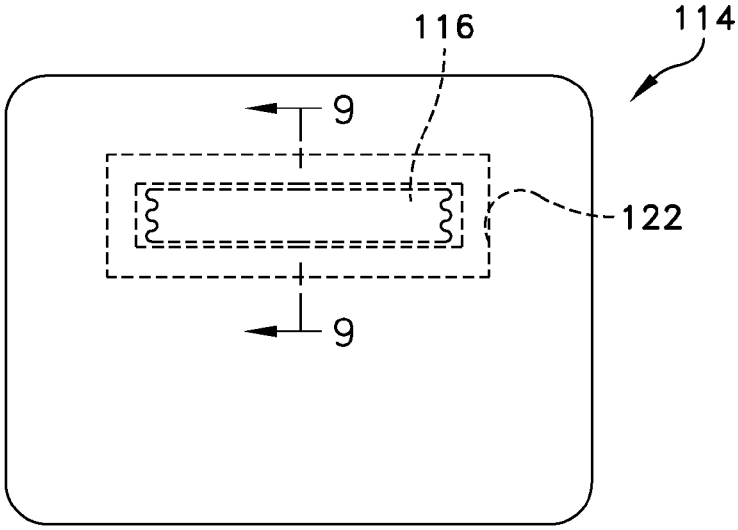
FIG. 8 is a bottom plan view of the box of FIG. 7.
Figure 9:
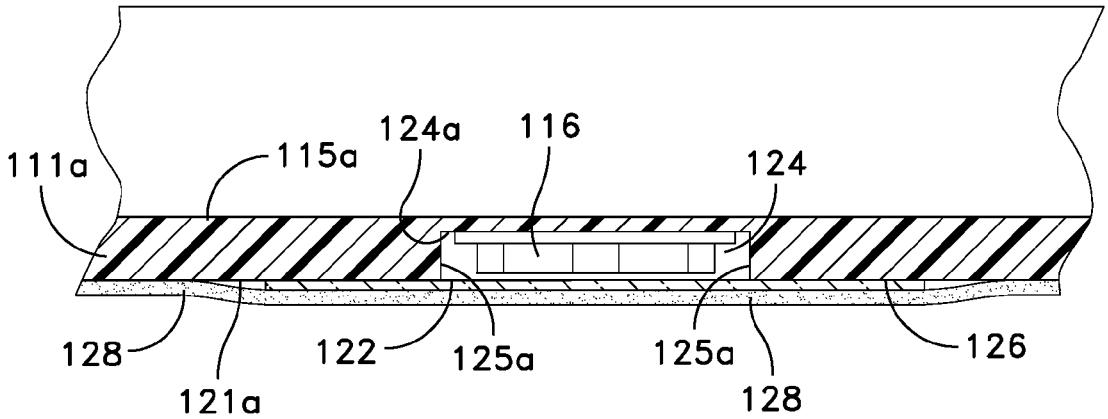
FIG. 9 is a cross-sectional view taken along lines 8-8 of FIG. 8.

Referring now to FIGS. 7-9, a second embodiment of a box for supporting an EAS sensor is illustrated. In this embodiment, the same or similar components as FIGS. 1-6 are labeled with the same reference numbers, preceded with the numeral "1". The anti-theft box 110 also includes a base 114 for receiving the EAS sensor 116 and a top cover 120 that engages the base 114 in a closed position. The box also includes a cavity 124 molded as a single, unitary piece with the base 114 and having a bottom wall 124*a*, sidewalls 125*a*, and a depth sufficient to receive the EAS sensor, as described above with respect to FIGS. 1-6. However, in the present embodiment, the cavity 124 and EAS sensor 116 are not visible in the assembled state, as outer layer 128 does not include an opening in the present embodiment. Thus, the outer layer 128 covers the opening 122 and cavity 124 in the assembled state. In this manner, the consumer cannot see the EAS sensor within the box. The method of manufacture is also the same, except it is simplified by the fact that there is no alignment of an opening of the outer layer with the opening bounding the cavity, as there is no opening in the outer layer.

Referring now to FIGS. 11-16, a third embodiment of a box for supporting an EAS sensor is illustrated. To simplify the description, only the base 214 of the box is illustrated. In this embodiment, the same or similar components as the previous two embodiments are labeled with the same reference numbers, preceded with the numeral "2".

The EAS sensor 216 is disposed within an opening 222 that extends through the base 214 from the inner surface 215*a* to the outer surface 221*a*. In the present embodiment, the opening 222 is configured and dimensioned to receive a cavity 224 which may be separately formed of a clear plastic material, for example by vacuum forming. Cavity 224 preferably includes an open end and a closed end, opposite the open end, including a recessed bottom wall 224*a*, sidewalls 225*a* extending from the bottom wall, and a flange 227 that circumscribes the sidewalls 225*a*. The cavity 224 has a depth sufficient to fit the EAS marker therein and the flange is sized larger than the opening 222 in the base 214 so that the inner surface 215*a* of the base 214 supports the flange 227 when assembled. In use, the base 214 supports the flange 227 such that the bottom wall 224*a* of the cavity is positioned substantially flush with the outer surface 221*a* of the base and the open end of the cavity faces toward the interior of the box. A cover 229 may also be provided to fit within the base so as to cover the open end of the cavity, further secure the cavity and EAS sensor in place, and provide a finished appearance to the base.

A method of forming the box 210 will now be described with reference to FIGS. 11-16.

As with the previous embodiments, the box 210 is injection molded from HIPS, and the outer surface 221 of the box may be covered with an outer covering. Opening 222 is then cut into the outer covering and the base 214 of the box, in any desired shape and size, for example rectangular, as illustrated. The preformed cavity having a bottom wall 224*a* and flange 227 is then inserted within the opening 222 such that the bottom wall 224*a* is positioned substantially flush with the outer surface 221*a* of the base and so that the flange 227 is supported by an inner surface 215*a* of the base. The EAS sensor 216 is then inserted within the cavity and cover 229 is placed over the cavity, including the flange. Alternately, the opening 222, the cavity 224, and EAS sensor 216 may be supported in the top, rather than the base, as would be known to those of skill in the art. A fourth embodiment of a box for supporting an EAS sensor will now be described with reference to FIGS. 17-22. To simplify the description, only the base 314 of the box is illustrated. In this embodiment, the same or similar components as the previous two embodiments are labeled with the same reference numbers, preceded with the numeral "3".

Figure 22:
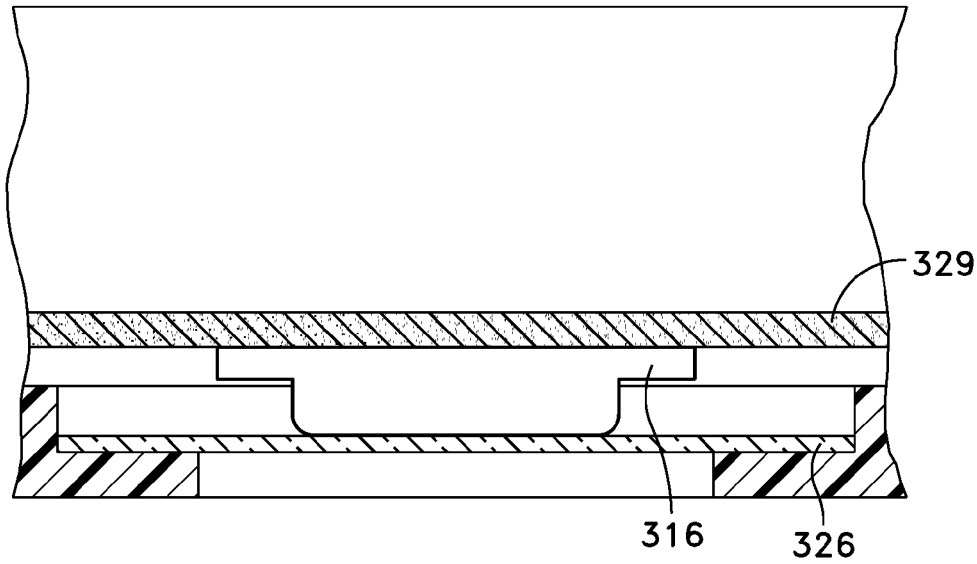
FIG. 22 is an enlarged view of the anti-theft tag box of FIG. 17.

In the present embodiment, the bottom portion 311*a* of the box includes a stepped opening 322 that extends through the bottom portion from the inner surface 315*a* to the outer surface 321*a*. The stepped opening 322 is larger at a first end, adjacent the inner surface 315*a* of the base and is smaller adjacent the outer surface 321*a* in order to support a separately formed cover 326 which may be made of a clear plastic material. As illustrated in the Figures, the stepped opening 322 includes a ledge 319 disposed between the inner surface 315*a* of the base and the outer surface 321*a* of the base, for supporting the cover 326. The cover 326 is sized so that it can be inserted within the first end of the opening, but rests on ledge 319 so that it is recessed with respect to both the outer surface 321*a* and the inner surface 315*a*, as best shown in FIG. 22. The EAS sensor is supported within the opening by the cover 326 which is substantially flat in the present embodiment. Adhesive may be provided to secure the cover 326 to the ledge 319 and also to secure the EAS sensor to the cover 326. A second cover 329 may also be provided to fit within the base on the inner surface, so as to cover the EAS sensor and opening 322, further secure the cover and EAS sensor in place, and provide a finished appearance to the base.

A method of forming the base 314 will now be described with reference to FIGS. 17-22.

As with the previous embodiments, the box including the base 314 is injection molded from HIPS, and the outer surface 321 of the box may be covered with an outer covering, for example paper, as would be known to those of skill in the art. Stepped opening 322 is then cut into the outer covering and through the base 314, in any desired shape and size, for example rectangular, as illustrated. The cover 326 is then positioned within the opening 322 such that the cover 326 rests on the ledge 319 and is recessed with respect to the outer surface 321*a* of the base 314. The EAS sensor 216 is then inserted into the opening 322 and may rest on the cover 326, within the opening 322, adjacent the inner surface of the base. Cover 229 may then be placed over the opening 322, including the EAS sensor. Alternately, the opening 322, cover 326 and EAS sensor 316 may be supported in the top, rather than the base, as would be known to those of skill in the art.

It will be understood by those skilled in the art that various changes in form and details may be made therein without departing from the spirit and scope of the invention as defined by the appended claims. For example, the materials disclosed herein may be readily changed, as may the molding parameters, dimensions and geometric configurations. Also, features shown in combination may not be used together, for example an outer covering may or may not be provided on the box. The term "top" and "bottom" may be used interchangeably, for example, the cavity and opening may be formed in the top cover instead of the base.

What is claimed is:

1. An anti-theft box for supporting an article, comprising:

a first member including a bottom portion having an inner surface and an outer surface, one or more side walls extending from the bottom portion, and an opening disposed in the bottom portion;

a second member, constructed and arranged to engage the first member, one of the first and second members including a support member therein constructed and arranged to support the article;

a cavity supported by the first member and including a bottom wall defining a closed end of the cavity, an open end, opposite the closed end, and side walls extending from the bottom wall to the open end, the cavity being configured and dimensioned to receive an electronic article surveillance sensor therein;

wherein the cavity is supported by the first member such that the bottom wall of the cavity is spaced from the outer surface of the bottom portion of the member a sufficient distance to support the electronic article surveillance sensor within the cavity below the outer surface of the bottom portion.

2. The anti-theft box of claim 1, further comprising a cover disposed over the opening in the bottom portion of the first member and the open end of the cavity so as to enclose the electronic article surveillance sensor within the cavity.

3. The anti-theft box of claim 2, wherein the cover is transparent so that the electronic article surveillance sensor is visible through the opening.

4. The anti-theft box of claim 2, wherein the cover is supported by the outer surface of the bottom portion of the first member.

5. The anti-theft box of claim 2, wherein the cover is supported by the inner surface of the bottom portion of the first member.

6. The anti-theft box of claim 1, wherein the opening in the first member extends through the member from the inner surface to the outer surface.

7. The anti-theft box of claim 1, wherein the opening in the first member extends through the outer surface of the bottom portion and does not extend through the inner surface of the bottom portion.

8. The anti-theft box of claim 1, wherein the cavity is formed as a separate piece from the first member and further includes a flange extending from the sidewalls of the cavity.

9. The anti-theft box of claim 8, wherein the flange is sized larger than the opening in the first member and is supported by the inner surface of the first member in an assembled state.

10. The anti-theft box of claim 9, wherein the cavity is configured and dimensioned such that when the flange is supported by the inner surface of the first member, the bottom wall of the cavity is substantially flush with the outer surface of the first member.

11. The anti-theft box of claim 1, wherein the first member further includes an outer layer secured to the outer surface of the bottom portion and the side walls of the first member.

12. The anti-theft box of claim 11, wherein the outer layer includes an opening disposed therethrough in alignment with the opening in the first member so that the electronic article surveillance tag is visible through the opening.

13. The anti-theft box of claim 1, wherein the first member includes both the cavity and the support member.

14. The anti-theft box of claim 1, wherein the first and second members are molded of plastic.

15. An anti-theft box for supporting an article, comprising:

a first member including a bottom portion having an inner surface and an outer surface and one or more side walls extending from the bottom portion;

a second member constructed and arranged to engage the first member;

one of the first and second members including a support member constructed and arranged to support the article;

a third member constructed and arranged to hinge the first member and the second member together;

an opening in the first member extending from the inner surface to the outer surface and having a stepped configuration such that the opening is larger adjacent the inner surface and smaller adjacent the outer surface and includes a ledge therebetween;

a cover constructed and arranged to fit within the opening adjacent the inner surface and larger than the opening adjacent the outer surface, the cover being further dimensioned to support an electronic article surveillance sensor;

wherein during use the cover is supported by the ledge and recessed with respect to the outer surface and the inner surface of the bottom portion.

16. The anti-theft box of claim 15, further including a second cover supported on the inner surface of the first member and covering the electronic article surveillance with respect to the outer surface and the inner surface of the bottom portion.

17. The anti-theft box of claim 15, wherein the cover is substantially flat and transparent so that the electronic article surveillance sensor is visible through the opening.

18. The anti-theft box of claim 15, wherein the first and second members are molded of plastic.

19. The anti-theft box of claim 15, wherein the first member includes both the cavity and the support member.

20. A method of manufacturing an anti-theft box comprising the steps of:

molding a first and a second member of plastic, the first and second members each including a bottom portion having an inner surface and an outer surface and one or more side walls extending from the bottom portion;

cutting an opening in the first member that extends from the inner surface to the outer surface of the first member;

forming a cavity having a bottom wall defining a closed end of the cavity, an open end, opposite the closed end, side walls extending from the bottom wall to the open end, and a flange extending from the side walls that is sized larger than the opening in the first member;

placing the bottom wall of the cavity through the opening until the flange is supported by the inner surface of the bottom portion adjacent the opening of the first member; and inserting an electronic article surveillance marker within the cavity.

21. The method of claim 20, further comprising the steps of placing a cover over the opening adjacent the open end of the cavity.

22. The method of claim 20, wherein the bottom wall of the cavity is substantially flush with the outer surface of the bottom portion.

* * * * *